United States Patent [19]

Corradini et al.

[11] Patent Number: 4,778,341

[45] Date of Patent: Oct. 18, 1988

[54] CENTRIFUGAL PUMP PARTICULARLY SUITABLE FOR PUMPING FLUIDS WITH A HIGH GAS CONTENT

[75] Inventors: Umberto Corradini, Montelupo Fiorentino; Erio Benvenuti, Florence, both of Italy

[73] Assignee: Nuovo-Pignone-Industrie Meccaniche e Fonderia S.p.A., Florence, Italy

[21] Appl. No.: 82,344

[22] Filed: Aug. 6, 1987

[30] Foreign Application Priority Data

Aug. 6, 1986 [IT] Italy ..... 21419 A/86

[51] Int. Cl.[4] ..... F04D 29/22

[52] U.S. Cl. ..... 416/181; 415/52; 416/183

[58] Field of Search ..... 416/181, 231 B, 182, 416/183; 415/52, 53 R, 121 A, 56, 58

[56] References Cited

U.S. PATENT DOCUMENTS

| | | | |
|---|---|---|---|
| 1,032,287 | 7/1912 | Kreher | 416/181 |
| 1,383,354 | 7/1921 | Wareing et al. | 416/183 |
| 1,622,930 | 3/1927 | Von Karman et al. | 416/183 |
| 2,276,077 | 3/1942 | Jacobsen | 415/53 R |
| 2,658,455 | 11/1953 | Seinfeld | 416/181 |
| 2,753,808 | 7/1956 | Kluge | 416/181 |
| 2,918,017 | 12/1959 | Collins | 416/181 X |
| 2,945,448 | 7/1960 | Frederick | 415/53 |
| 3,213,794 | 10/1965 | Adams | 416/181 X |
| 4,152,092 | 5/1979 | Swearingen | 415/53 R |
| 4,221,540 | 9/1980 | Savonuzzi | 416/183 X |

FOREIGN PATENT DOCUMENTS

| | | | |
|---|---|---|---|
| 2357305 | 5/1975 | Fed. Rep. of Germany | 416/181 |
| 2734479 | 2/1979 | Fed. Rep. of Germany | 416/181 |
| 2757572 | 7/1979 | Fed. Rep. of Germany | 416/181 |
| 1321270 | 2/1963 | France | 416/181 |
| 72501 | 6/1979 | Japan | 416/181 |
| 225697 | 12/1968 | U.S.S.R. | 415/52 |

*Primary Examiner*—Everette A. Powell, Jr.

*Attorney, Agent, or Firm*—Birch, Stewart, Kolasch & Birch

[57] ABSTRACT

A centrifugal pump for handling fluids with a high gas content, wherein the impeller is provided with a through-bore connected with the inlet of each outflow channel, as well as with at least one small bore inside each channel. The blades are not very divergent relatively to each other, and each of the blades is split into two parts by a vertical slot. Also a large number of small-sized channels are used to define the diffuser outflow channels.

1 Claim, 2 Drawing Sheets

CENTRIFUGAL PUMP PARTICULARLY SUITABLE FOR PUMPING FLUIDS WITH A HIGH GAS CONTENT

The present invention relates to a centrifugal pump which, by minimizing the phenomenon of separation of the liquid and gas phases, makes it possible to efficaciously pump fluids, particularly those which contain large volume percents of gases.

From the present state of the art, several forms of centrifugal pumps are already known, but all of these pumps are of the traditional type, i.e., designed for handling liquids, and thus are not at all capable of pumping liquid/gas mixtures with a high gas content, where, between the blades of the impeller a separation of the two phases occurs, which invalidates the principles on which a centrifugal impeller operates, that is, the deceleration of the fluid in the relative motion between the input and the output of the channels bound by the blades, and the effect of the centrifugal field on pressure increase.

In fact, due to the impact of the liquid/gas mixture against the leading edge of the blades of the impeller, and due to the different specific gravity of the two components of the mixture, a separation of said components occurs, and connected with said edges on the low pressure side, a gas (air) bubble forms which, by reducing the actual cross-section surface area through which the liquid component passes, an increase in the outlet speed W at which the handled fluid leaves the blades of said component is caused, and, consequently, a considerable decrease in the tangential component CU of the resultant C of the said outlet speed W and the peripheral speed U of the same impeller, to which the obtainable pressure value is proportional.

Furthermore, in the diffuser, downstream of the impeller, a transformation of the kinetic energy of the pressurized fluid is made difficult by the presence of the gas because, as it happens in the impeller, a separation of the phases occurs, which prevents the decelerating of the fluid, and the consequent increase in pressure.

The purpose of the present invention is precisely to obviate the above drawbacks, and provide a centrifugal pump which efficaciously counteracts the separation of the phases, and hence makes it possible to pump fluids which also contain a large amount of gas.

This purpose is substantially achieved by providing a bore connected with each inlet between the blades of the impeller, which is the most delicate and critical area, in that it is here that the highest pressure gradients are generated which create the separation or layering, of the phases. In this way, the gas bubbles are in fact destroyed which, as already stated, are the main cause of missed fluid deceleration, and hence of the missed pressure increase.

On the other side, for the purpose of maintaining the fluid as homogeneous as possible inside the channels defined by the blades, the impeller is equipped with blades with a very low fluid-dynamic load relatively to that of the traditional impellers, that is, with blades arranged less divergent relatively to each other, and, furthermore, with each blade being split into two parts, interrupted by a vertical cut provided along the approximate middle of its development. Such cuts constitute passage slots which allow the liquid phase of a channel to mix with the gas phase of an adjacent channel, thus rendering the flow more homogeneous.

For the same purpose of a better homogeneization of the stream, the impeller is also provided with at least a small more provided inside the disc inside each channel, which has the purpose of making it possible for the liquid phase which has been dispersed inside the chamber of the pump-body situated behind the impeller, to re-enter the channel and mix with the effluent fluid.

Finally, the diffuser is provided with a large number of outflow channels of small dimensions, which perform the double function of minimizing the phenomenon of separation of the phases, as well as of making it possible to efficaciously use the large momentum of the liquid phase of the stream, associated with the large specific gravity of the same liquid, for compressing the gas phase, and hence expelling the gas bubbles.

In summary, the centrifugal pump for pumping gas-containing fluids, said pump comprising an impeller equipped with blades which are divergent relatively to each other for defining outflow channels for the fluid, as well as a diffuser, and provided with fluid outflow channels, is characterized according to the present invention in that, connected with each inlet to the outflow channels defined by the blades of the impeller, on the disc of the same impeller a through-bore is provided, as well as at least one small bore inside each outflow channel, the blades of the impeller being positioned with not much divergence relatively to each other, and each blade is split into two parts by a vertical slot arranged approximately along the middle of its development, while the diffuser outflow channels are constituted by a large number of small-size channels.

The present invention is now better clarified by referring to the attached drawings, which illustrate a preferred form of a practical embodiment, supplied for only exemplifying and non-limitative purposes, in as much as technical or structural variants can be supplied at any time, within the purview of the present invention.

IN THE DRAWINGS

The present invention will become more fully understood from the detailed description given hereinbelow and the accompanying drawings which are given by way of illustration only, and thus are not limitative of the present invention, and wherein.

Figure 2:
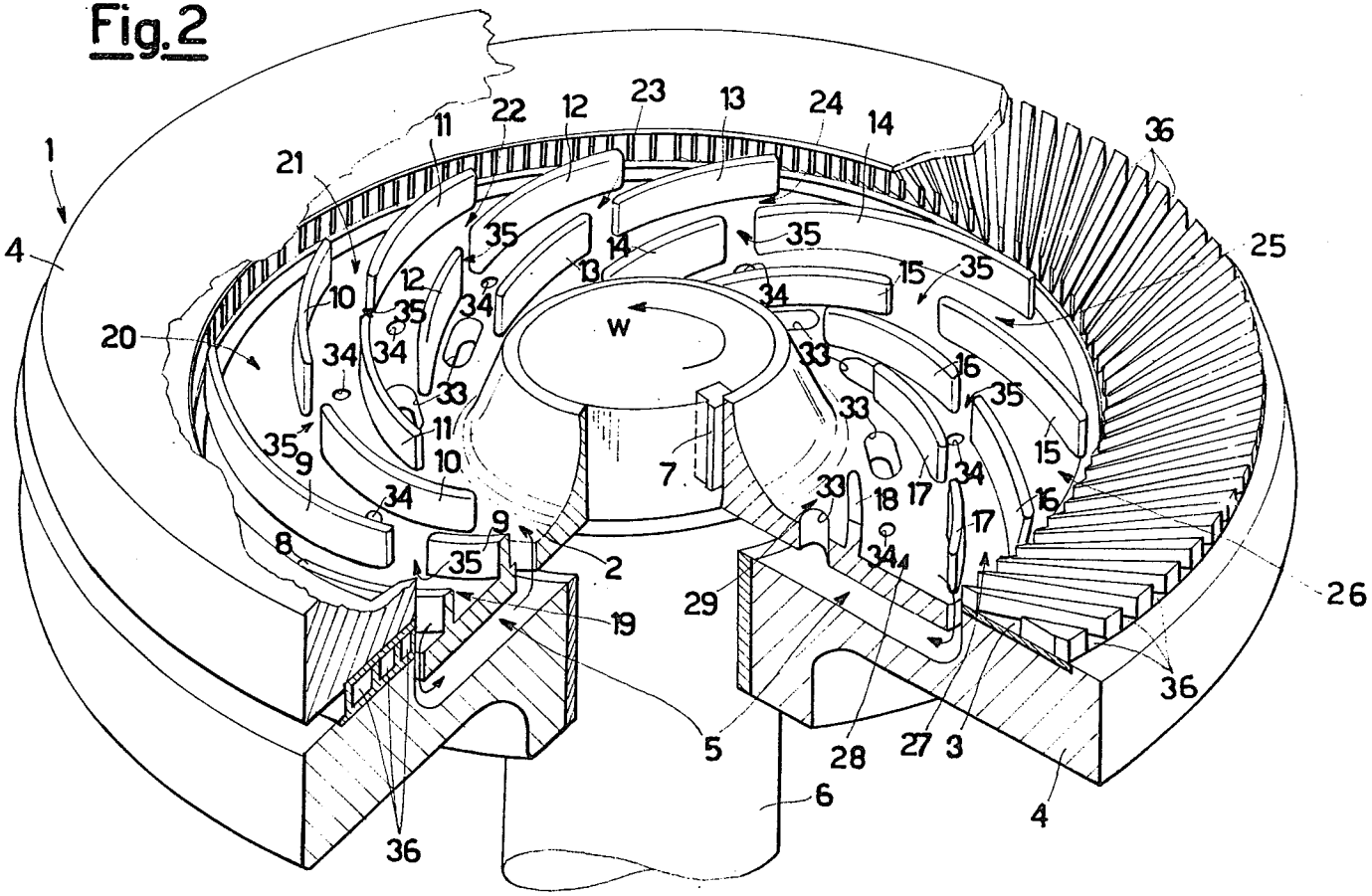
FIG. 2 shows a partial, and partially cutaway, perspective view of a centrifugal pump according to the present invention.

Referring to the figures, the centrifugal pump 1 is substantially constituted by an impeller 2 and a diffuser 3. The diffuser is integral with the pump body 4, which forms a chamber 5, inside which the impeller 2, integral with the spindle 6 through the key 7, revolves according to the direction of arrow "w". The impeller 2 is equipped with a set of blades, 8, 9 . . . 18 . . . , respectively as can be seen in FIG. 2, which are divergent from each other and define corresponding fluid outflow channels 19, 20 . . . 29 . . . .

Figure 1:
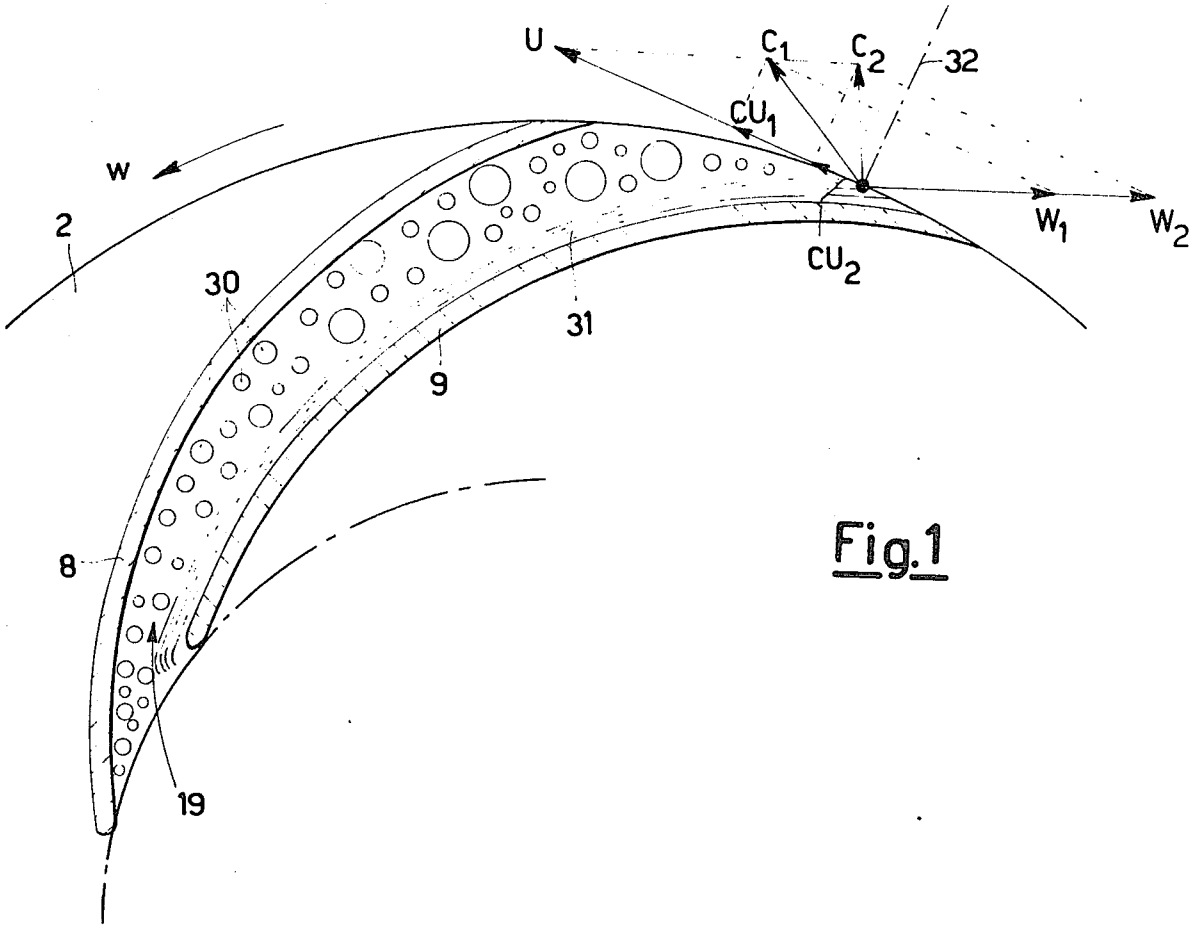
FIG. 1 shows the vectorial diagram of the speed at the outlet from an outflow channel.

As can be clearly seen in FIG. 1, in the presence of a fluid with a large gas content, inside the outflow channel 19, bounded by the blades 8 and 9, a separation occurs between the gas phase 30 and the liquid phase 31. The gas phase, due to the different specific gravity, and the revolutionary motion, according to arrow "w", of the impeller, is squeezed against the underlying blade 9. The consequent reduction in the passage cross-sectional surface area for the liquid phase, which is no longer given by the whole cross-section surface area of the channel 19, but by a position thereof only, causes, as a consequence, an increase in the speed of exit from the blades, of the liquid phase, from "$w_1$" value down to "$w_2$" value. Thus the resultant of said speed and the peripheral speed U of the impeller 2 results in a vector $C_2$ diferent from $C_1$, both for intensity and for direction, and the tangential component $CU_2$ thereof, which is proportional to the pressure which can be generated. The results are considerably smaller than $CU_1$, that is the value which would be obtained in the absence of a gas.

In summary, the larger the gas content of the fluid, the closer the resultant vector C approaches the radial direction 32, under which condition the value of the tangential component CU is zero and hence no pressure is generated.

Therefore, to avoid the deleterious effect of phase separation and maintain the fluid as homogeneous as possible, according to the present invention through-bores 33 connected with the inlets of the outflow channels 19, . . . 29, . . . , as well as small bores 34 inside each outflow channel, are provided in the impeller 2. The blades 8, . . . 18, . . . of the impeller 2 are positioned to be not so divergent relatively to each other, and furthermore they are cut along the middle of their structure for the purpose of creating passage slots 35 which make it possible for the fluid to pass from one channel to an adjacent channel. Finally, in the diffuser 3 a large number of small-size outflow channels 36 are provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A centrifugal pump for pumping gas-containing fluids which comprises:

an impeller, a plurality of blades extending from the surface of said impeller, said blades being divergently disposed relative to each other for defining outflow channels for the fluid, and a diffuser peripherally disposed with respect to the impeller, said diffuser also being provided with a plurality of small-size channels, wherein through-bores are provided in the impeller at the inlet to the outflow channels defined by the impeller blades, through-bores are provided inside each outflow channel defined by the impeller blades, and each blade is divided by a vertical-extending slot into two parts.

* * * * *